US010510209B2

(12) United States Patent
Witty et al.

(10) Patent No.: US 10,510,209 B2
(45) Date of Patent: Dec. 17, 2019

(54) GAMING SYSTEM AND AN ASSOCIATED METHOD

(71) Applicant: Gaming Entertainment Systems Pty Limited, Hornsby (AU)

(72) Inventors: Simon Witty, Hornsby (AU); Harley Jackson, Hornsby (AU)

(73) Assignee: Gaming Entertainment Systems Pty Limited, Hornsby, New South Wales (AU)

( * ) Notice: Subject to any disclaimer, the term of this patent is extended or adjusted under 35 U.S.C. 154(b) by 529 days.

(21) Appl. No.: 15/302,928

(22) PCT Filed: Apr. 9, 2015

(86) PCT No.: PCT/AU2015/000213
§ 371 (c)(1),
(2) Date: Oct. 7, 2016

(87) PCT Pub. No.: WO2015/154134
PCT Pub. Date: Oct. 15, 2015

(65) Prior Publication Data

US 2017/0032616 A1 Feb. 2, 2017

(30) Foreign Application Priority Data

Apr. 9, 2014 (AU) ..... 2014901287

(51) Int. Cl.
*G07F 17/32* (2006.01)

(52) U.S. Cl.
CPC ..... *G07F 17/3251* (2013.01); *G07F 17/3211* (2013.01); *G07F 17/3225* (2013.01); *G07F 17/3241* (2013.01); *G07F 17/3246* (2013.01)

(58) Field of Classification Search
CPC ..... G07F 17/3251; G07F 17/3211; G07F 17/3225; G07F 17/3241; G07F 17/3246
(Continued)

(56) References Cited

U.S. PATENT DOCUMENTS 7,758,049 B2 * 7/2010 Johnston ..... G07F 17/32 273/142 E
2002/0090988 A1 * 7/2002 Frost ..... A63F 3/081 463/17

(Continued)

OTHER PUBLICATIONS

International Search Report in PCT International Application No. PCT/AU2015/000213, dated Jul. 1, 2015.

(Continued)

*Primary Examiner* — Michael A Cuff
(74) *Attorney, Agent, or Firm* — Venable LLP; Henry J. Daley

(57) ABSTRACT

An embodiment of the gaming system includes at least one voucher dispenser (11). Each voucher (24) is associated with data. A gaming controller 8 is communicatively linked to the voucher dispenser (11) and it receives and stores the data. At least one game, in particular a table game such as roulette, is configured to generate game results and communicate them to the gaming controller (8). The embodiment also includes at least one activator device (28) at which the vouchers (24) are activatable. The activator devices are communicatively linked to the gaming controller (8) such that an activation of a voucher (24) causes the gaming controller (8) to determine a redeemable value of the voucher (24) based upon the game results of a number of game plays. Another embodiment of the gaming system does not require the players to activate the vouchers. This embodiment automatically determines the first game that will be applicable to a dispensed voucher and provides the player with an indication of the game number of that first game.

33 Claims, 14 Drawing Sheets

(58) Field of Classification Search
USPC ..... 463/16–20
See application file for complete search history.

(56) References Cited

U.S. PATENT DOCUMENTS

| | | | | |
|---|---|---|---|---|
| 2003/0008707 | A1* | 1/2003 | Walker | G06Q 30/02 463/25 |
| 2004/0032083 | A1* | 2/2004 | Walker | G06Q 10/087 273/269 |
| 2004/0087357 | A1* | 5/2004 | Johnson | G07F 17/32 463/17 |
| 2005/0107153 | A1* | 5/2005 | Jubinville | G07F 17/32 463/18 |
| 2005/0116410 | A1* | 6/2005 | Vlazny | G07F 17/32 273/139 |
| 2006/0009274 | A1 | 1/2006 | Finocchio | |
| 2006/0172799 | A1* | 8/2006 | Kane | G07F 17/32 463/25 |
| 2008/0004108 | A1 | 1/2008 | Klinkhammer | |
| 2012/0271697 | A1* | 10/2012 | Gilman | G06Q 20/387 705/14.23 |
| 2013/0005426 | A1* | 1/2013 | Nicely | G07F 17/32 463/20 |
| 2013/0065668 | A1 | 3/2013 | LeMay et al. | |

OTHER PUBLICATIONS

Australian Application No. 2015245936 Examination Report dated Feb. 14, 2019.

* cited by examiner

GAMING SYSTEM AND AN ASSOCIATED METHOD

TECHNICAL FIELD

The present invention relates to a gaming system and an associated method. Embodiments of the present invention find application, though not exclusively, in casinos for use with table games such as roulette by way of non-limiting example.

BACKGROUND ART

Any discussion of documents, acts, materials, devices, articles or the like which has been included in this specification is solely for the purpose of providing a context for the present invention. It is not to be taken as an admission that any or all of these matters form part of the prior art base or were common general knowledge in the field relevant to the present invention as it existed in Australia or elsewhere before the priority date of this application.

Klinkhammer (US2008/0004108 A1) discloses a method of connecting a game terminal to one or more roulette tables. A player selects certain wagering options on the game terminal pertaining to a roulette table of the player's selection. The game terminal issues a ticket with a certain starting time. The player takes the ticket to the table to oversee the outcomes of the games beginning at the start time on the ticket. In one embodiment, the player selects 10 numbers over 15 games, and following the play of 15 games the player may be awarded a prize determined by the number of matching games and optionally the order of the matching games Klinkhammer discloses that the second type of game has different rules of play from the first type of game.

A key drawback of this approach is the fixed predetermined starting time of the ticket. There are a number of reasons players might find this aspect inconvenient. One reason is the lack of clocks in some casinos. Another reason is that a player might arrive at the selected table at the selected starting time and wrongly believe that the ticket is active, or wrongly believe that the ticket is not yet active, due to the system clock not being exactly synchronised with the player's watch. Or the player might get delayed or sidetracked en route to the selected gaming table due to unforeseen circumstances and subsequently miss one or more games.

Another drawback of this approach is that the player must select at which roulette table to place wagering options whilst at the gaming terminal. Live casino game players are often influenced by situational events at roulette tables such as recent winning outcomes or sequences and runs of previous outcomes or the orientation of a particular table or which dealer is currently operating any particular table or to what extent players at any particular table are having a run of luck. Players tend to act on such impulses when deciding at which roulette table to place their bets and this is not easily determined whilst at a gaming terminal.

Another drawback of this approach is that the player must complete the consecutive run of games as specified on the ticket. There are various reasons this may not be desirable. For example, at some point after the ticket starting time, the dealer might be replaced by another dealer not to the player's liking. Or the player may be unexpected called away from the table, causing the player to miss out on seeing some of the games. Or there may be a dispute or delay at the table which the player is forced to endure in order to see out the remaining games on their ticket.

SUMMARY OF THE INVENTION

It is an object of the present invention to overcome, or substantially ameliorate, one or more of the disadvantages of the prior art, or to provide a useful alternative.

In one aspect of the present invention there is provided a gaming system including:

at least one voucher dispenser configured to be responsive to an input so as to dispense vouchers to players, each voucher being associated with data identifying the voucher and specifying a number of game plays;

a gaming controller communicatively linked to the voucher dispenser and being configured to receive and store said data associated with each voucher;

at least one game being configured to generate game results, the game being communicatively linked to the gaming controller so as to communicate game results to the gaming controller; and at least one activator device at which the vouchers are activatable, the activator device being communicatively linked to the gaming controller such that an activation of a voucher causes the gaming controller to determine a redeemable value of said voucher based upon the game results of the number of game plays as specified in the data associated with said voucher.

In one embodiment the vouchers are a substrate having indicia printed thereon. In another embodiment the vouchers are digital devices. In yet another embodiment the vouchers are in the form of information communicated to player's hand held digital devices.

In an embodiment the at least one voucher dispenser is a player's hand held digital device. Preferably indicia indicative of at least some of the data is displayed on a display of the player's hand held digital device.

Preferably the data includes a player defined betting structure and the gaming controller is responsive to an identification of a voucher so as to retrieve the betting structure associated with said voucher and so as to determine the redeemable value in accordance with the betting structure associated with said voucher.

The voucher dispenser may be configured to dispense a voucher in response to settlement of a payment transaction in which the player pays for the voucher. Alternatively, the activator device may be configured to activate a voucher in response to settlement of a payment transaction in which the player pays for the voucher.

The vouchers may be activatable in respect of the game results generated at any one of a plurality of games. Alternatively, the vouchers may be activatable in respect of the game results generated across a plurality of games.

Preferably the activator device is configured to execute a validation routine so as to determine if a voucher was validly dispensed by the system and to only activate said voucher if the validation routine indicates that said voucher is valid.

The gaming controller may be configured to deactivate a voucher once the specified number of game plays have been played.

Preferably the game includes a display driven to identify vouchers that are currently active and/or currently winning on said game.

Preferably the activator device is configured to be responsive to an input so as to suspend activation of a voucher prior to the specified number of game play being completed, the suspended voucher being subsequently re-activatable.

The gaming system preferably includes at least one redemption device configured so as to redeem the redeemable value of a voucher to a player.

In one embodiment the game results are viewable on a display of a player's hand held digital device.

Preferably a time period between a dispensing of a voucher and activation of said voucher is player dependent.

In one embodiment a cut-off point is defined, whereby prior to the cut-off point the voucher is activatable in respect of a current game and subsequent to the cut-off point the voucher is activatable in respect of a following game. Preferably the cut-off point is defined as a stage of progression of the current game.

In one embodiment the activator device is a player's hand held digital device.

In a second aspect of the present invention there is provided a gaming method including the steps of:

dispensing vouchers to players, each voucher being associated with data identifying the voucher and specifying a number of game plays, and communicating the data to a gaming controller;

providing a game being configured to generate game results and to communicate said game results to the gaming controller; and being responsive to an activation of a voucher so as to cause the gaming controller to determine a redeemable value of said voucher based upon the game results of the number of game plays as specified in the data associated with said voucher.

In one embodiment the data includes a plurality of possible game results upon which bets are to be placed. In this embodiment the redeemable value includes a bonus award if the game results of the number of game plays as specified in the data associated with the voucher matches the plurality of possible game results.

Preferably the selected game is roulette and the plurality of possible game results upon which bets are to be placed are a plurality of numbers that may be generated by the operation of one or more roulette tables.

In another aspect of the present invention there is provided a gaming system including:

at least one voucher dispenser configured to be responsive to an input so as to dispense a voucher to a player;

a gaming controller communicatively linked to the voucher dispenser; and at least one gaming device being configured to generate game results, the at least one gaming device being communicatively linked to the gaming controller so as to communicate a current status of the at least one gaming device to the gaming controller;

wherein the gaming controller is configured to collate game numbers associated with each game executed upon the at least one gaming device;

wherein the voucher dispenser is responsive to the input so as to send a request to the gaming controller for a commencing game number for a voucher that is to be dispensed;

wherein the gaming controller is responsive to receipt of the request so as to analyse the current status of the at least one gaming device so as to determine the commencing game number and so as to communicate the commencing game number to the voucher dispenser; and wherein the voucher dispenser is responsive to receipt of the commencing game number so as to dispense a voucher and provide an indication to the player of the commencing game number for the voucher.

In one embodiment the indication to the player is printed on the voucher. In another embodiment the voucher dispenser includes a display and the indication to the player is displayed on the display.

Preferably the gaming device is a roulette table.

In one embodiment the gaming controller is configured to analyse the current status of the at least one game device so as to determine a number of gaming devices that have passed a cut-off point and to increment a current game number by the number of gaming devices that have passed the cut-off point so as to calculate the commencing game number. In another embodiment the gaming controller is configured to analyse the current status of the at least one game device so as to determine a number of gaming devices that have passed a cut-off point and to increment a current game number by the number of gaming devices that have passed the cut-off point and to increment this amount by a predefined number of games so as to calculate the commencing game number.

The features and advantages of the present invention will become further apparent from the following detailed description of preferred embodiments, provided by way of example only, together with the accompanying drawings.

BRIEF DESCRIPTION OF THE ACCOMPANYING DRAWINGS

DETAILED DESCRIPTION OF PREFERRED EMBODIMENTS OF THE INVENTION

Figure 1:
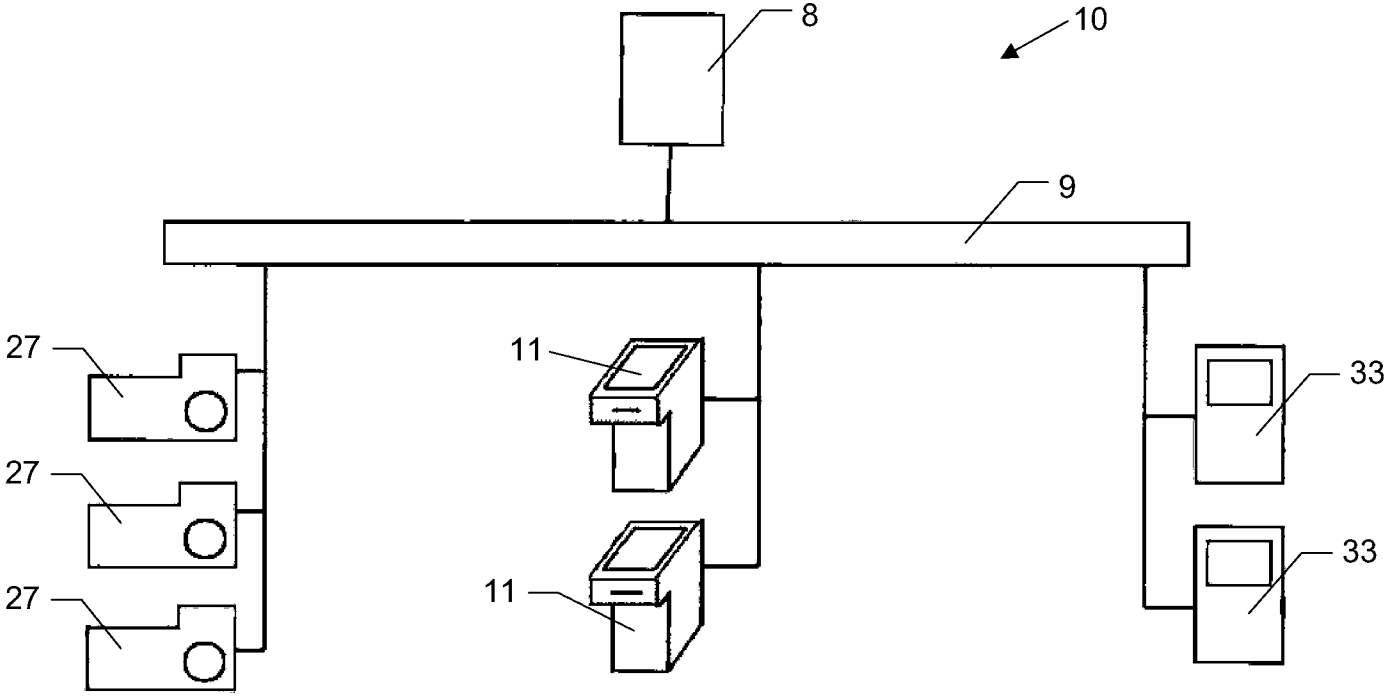
FIG. 1 is a schematic representation of a system in accordance with a preferred embodiment of the present invention.
Figure 2:
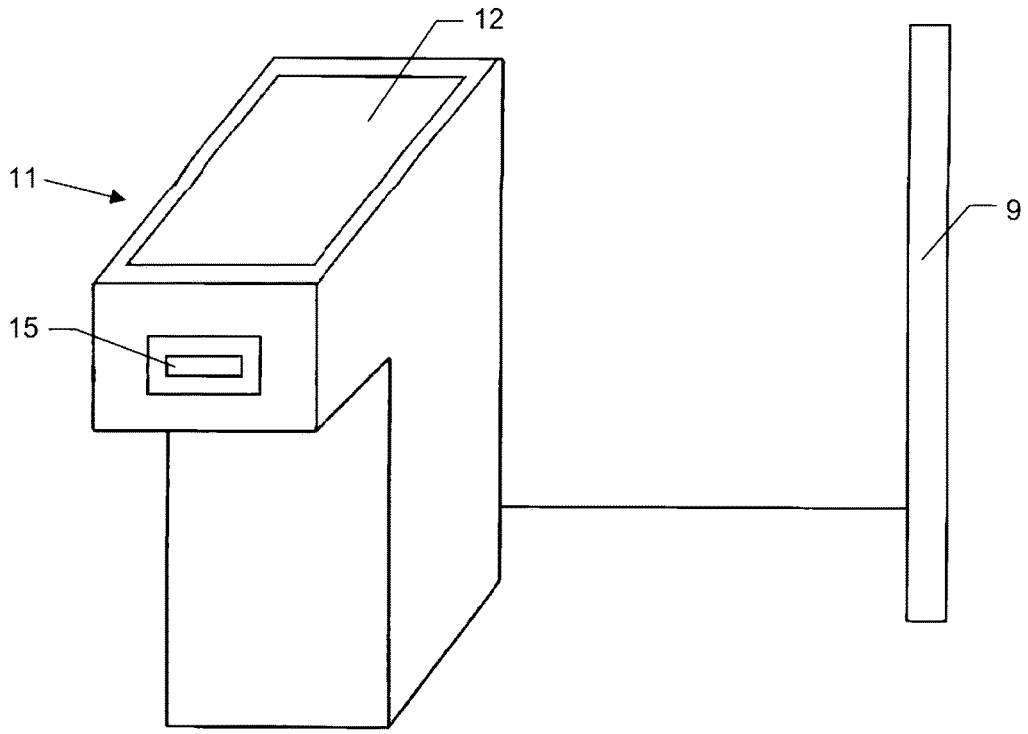
FIG. 2 is a schematic representation of a voucher dispenser in accordance with a preferred embodiment of the present invention.
Figure 3:
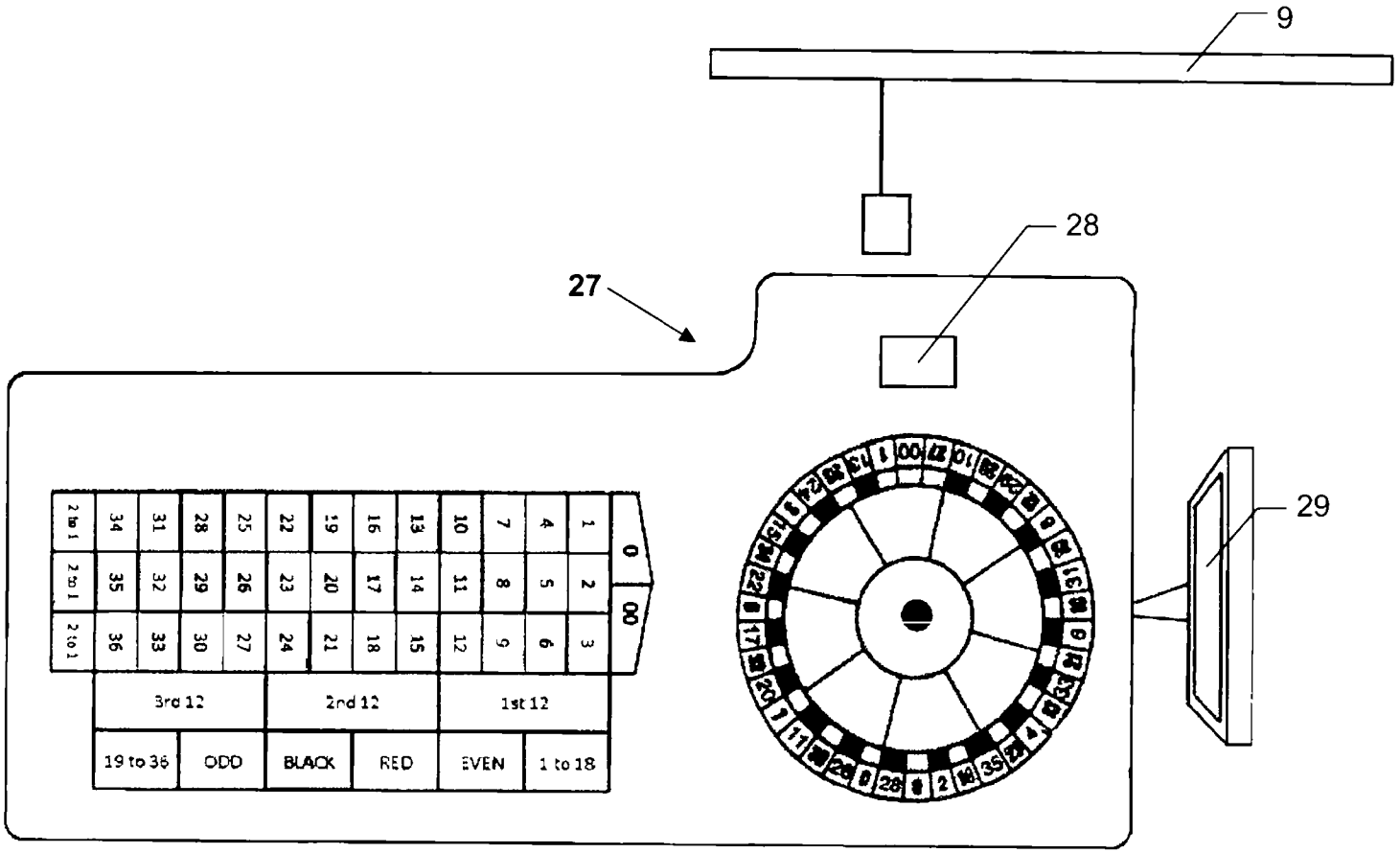
FIG. 3 is a schematic representation of a game in accordance with a preferred embodiment of the present invention.

With reference to FIG. 1, the gaming system 10 includes a pair of voucher dispensers 11. Additional depictions of voucher dispensers 11 may be seen in FIGS. 2 and 4-10. As best shown in FIG. 5, the voucher dispenser 11 is in the form of a player-operable free standing kiosk, which would typically be positioned within a publicly accessible space within a casino establishment, or the like. The voucher dispenser 11 includes an input module in the form of a touch sensitive display screen 12. The body 13 of the voucher dispenser 11 includes a first slot 14, through which a player may feed currency to an automated bill collector that is housed within the body 13. Other embodiments make use of alternative or additional funds transfer means. A printer is disposed within the body 13 such that its output is aligned with a second slot 15, which is disposed upon the body 13 below the first slot 14 for the dispensing of paper-based vouchers. The voucher dispenser 11 includes a processor, which has access to data storage means such as random access memory or the like. Additionally, the voucher dispenser is communicatively linked to a game controller 8 (to be discussed in detail below) via a private network 9, which may be in the form of a WAN, LAN, etc.

Figure 17:
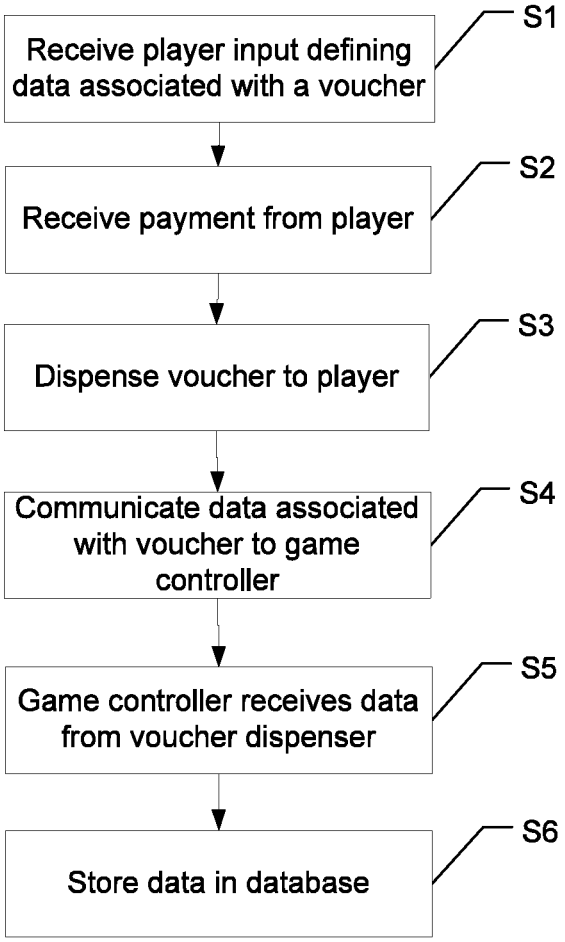
FIGS. 17 to 19 are flow charts showing steps performed in accordance with a preferred embodiment of the present invention.

At Step S1 of FIG. 17, the player provides inputs to the processor of the voucher dispenser 11 by touching selected portions of the touch sensitive display screen 12. This allows the player to define a betting structure defining a series of bets that the player wishes to place on a number of game plays, including the type and size of bets, and the game outcomes on which the player wishes to place bets.

Figure 6:
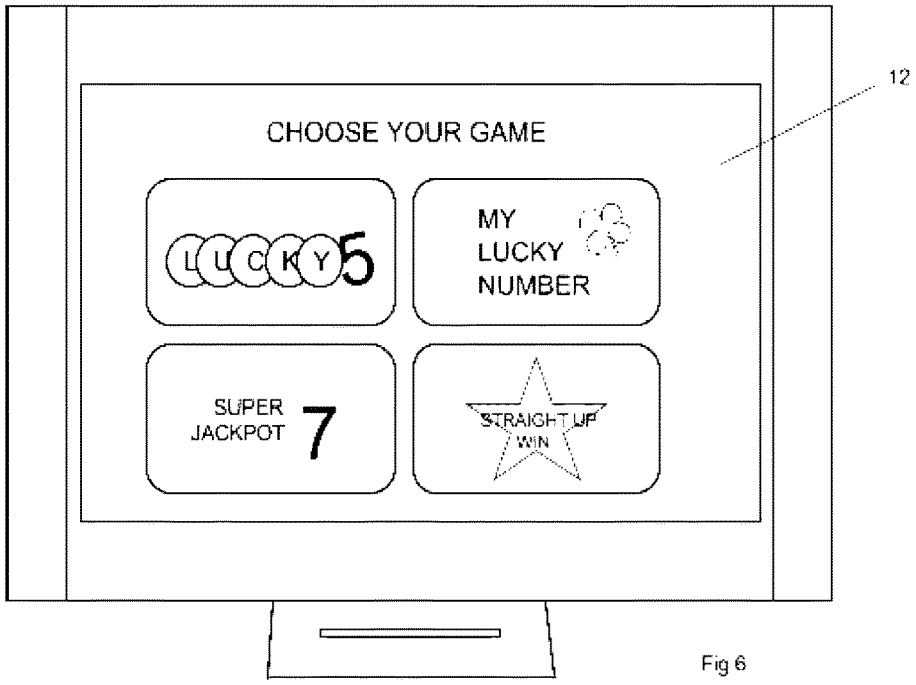
FIGS. 6 to 10 are successive views of screens as displayed by the voucher dispenser of FIG. 5.
Figure 7:
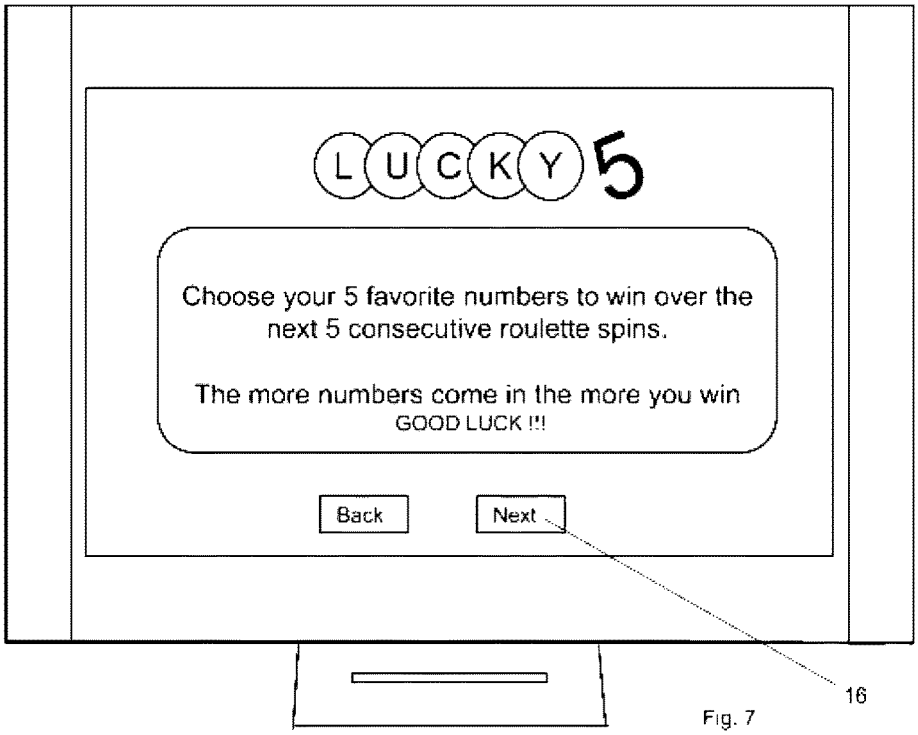

The screen initially displayed to the player at the commencement of this process is best shown in FIG. 6. The player has the option of choosing one of four possible voucher types, referred to as 'LUCKY 5', 'MY LUCKY NUMBER', 'SUPER JACKPOT 7' and 'STRAIGHT UP WIN'. For the sake of a running example, we shall assume that the player selects the 'LUCKY 5' voucher type. The processor of the voucher dispenser then drives the touch sensitive screen 12 to display the screen illustrated in FIG. 7, which informs the player of the basic rules associated with the 'LUCKY 5' voucher type. More particularly, the player is informed that they are to choose 5 numbers, which will be applicable to 5 consecutive roulette games. Hence, the player input selecting the 'LUCKY 5' voucher type commences the compilation of data associated with the voucher that is to be dispensed, with the first item of data being a number of game plays, which in this case is 5. As the player makes this and other selections, the processor of the voucher dispenser 11 stores this data in its memory.

Figure 8:
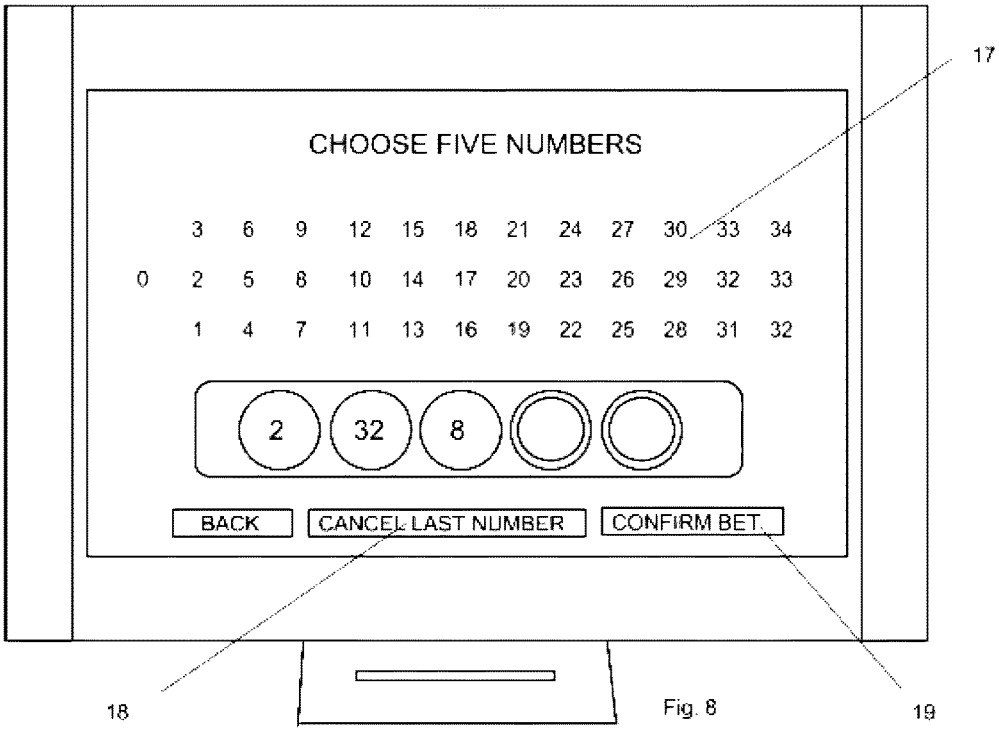
Figure 9:
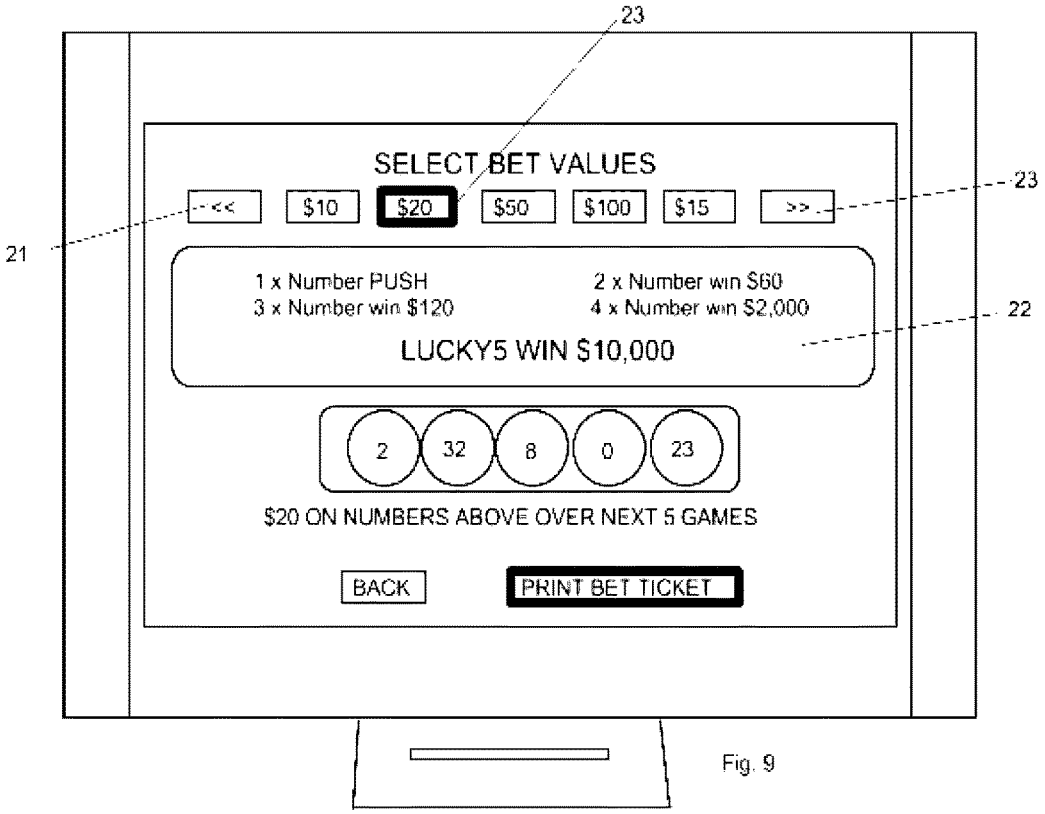

Once the player has read the basic rules, he or she pushes the 'NEXT' button 16 and the processor of the voucher dispenser 11 then drives the screen 12 to display the screen illustrated in FIG. 8, which depicts a input region 17 in which the various possible numbers that may arise from a roulette game (i.e. 0 to 36) are depicted. The player then selects five numbers by pressing each desired number from within the input region 17. As shown in FIG. 8, and for the sake of a running example, the player has selected numbers 2, 32, 8 and still has two remaining numbers to select. If a number is selected in error, the player can cancel the error by pressing the 'CANCEL LAST NUMBER' button 18. For the sake of the running example we shall assume that the player selected 2, 32, 8, 0 and 23. Once all five numbers have been selected the player presses the 'CONFIRM BET' button 19. In response to the pressing of the 'CONFIRM BET' button 19, the processor of the voucher dispenser causes the values of the five selected numbers to be stored in memory. The processor of the voucher dispenser then causes the screen 12 to display the screen as depicted in FIG. 9. This provides the player with the following options to select as a bet value: $10, $15, $20, $50 and $100. If they player wishes to select a bet value that is higher or lower than these options, he or she may press either the '>>' button 20 or the '<<' button 21, which causes the controller to depict other betting value options from which the player may choose. As shown in FIG. 9, and for the sake of the running example, we shall assume that the player selects the $20 bet value option by pressing the '$20' button 23. In response to this, the controller not only stores the selected bet value in its memory, but also causes a pay table corresponding to the selected bet value to be displayed in region 22 of the screen. As shown from FIG. 9, the pay table associated with the $20 bet value is as follows:

| Number of Matching Numbers | Return to Player |
|---|---|
| 0 | $0 |
| 1 | $20 |
| 2 | $60 |
| 3 | $120 |
| 4 | $1,000 |
| 5 | $10,000 |

At Step S2 the player pays for the voucher by inserting $20 into the first slot 14. In an alternative embodiment, the payment is made at a subsequent stage of this process and this alternative embodiment will be described later in this detailed description. The insertion of the currency into the first slot 14 is sensed, validated and quantified by the bill collector. If the bill collector ascertains that the inserted currency is valid, it sends a signal to the processor confirming that the determined quantum of payment has been made. If the bill collector determines that the currency is invalid, it ejects the inserted currency from the first slot and provides the player with an opportunity to re-insert valid currency.

Figure 11:
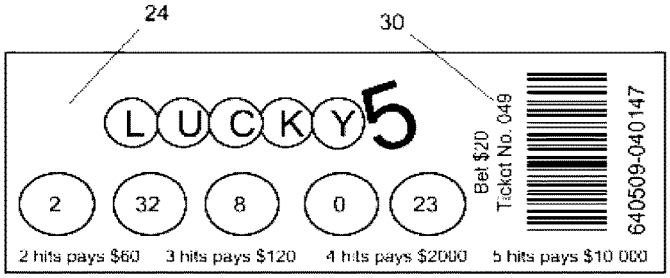
FIG. 11 is a plan view of a printed voucher in accordance with a preferred embodiment of the present invention.

Once the processor receives the signal confirming the quantum of payment that has been made, the processor checks that the quantum of the payment transaction is equal to, or exceeds, the amount of the bet as previously selected by the player, which in the running example is $20. If there is an excess, the processor instructs the bill collector to refund the difference. Once the processor determines that the payment transaction has been settled, the process flow proceeds to Step S3 at which the processor drives the printer so as to print a voucher 24 on a substrate. An example of such a voucher, which is consistent with the running example, is shown in FIG. 11. It includes the following indicia that is indicative of the data:

- a reference to the 'LUCKY5' game that is being played;
- a listing of the five numbers selected by the player;
- a summary of the pay table;
- a listing of the amount bet;
- a listing of the ticket identification number; and
- a bar code, which encodes the identification number into a machine readable format (although other such formats, such as a QR code or text showing a PIN number that may be recognised by optical character recognition, or the like, may be used in other embodiments).

Figure 10:
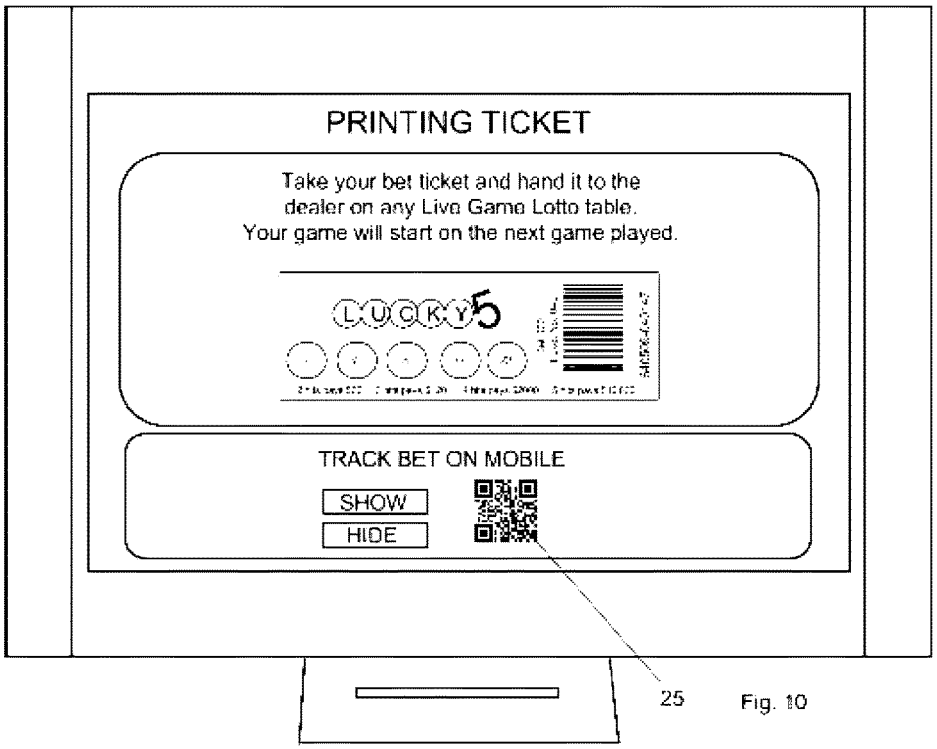

Whist the printer is printing the voucher, the processor drives the screen 12 to show the screen depicted in FIG. 10, which instructs the player to take the ticket and hand it to the dealer on a game that they wish to play. Additionally, the screen displays a QR code 25, which may be photographed on the player's hand held mobile device, such as mobile phone 26. Once photographed, decoding software on the mobile phone 26 decodes the QR code, which points to a web site that is hosted by the game controller 8. The functionality of this web site will be described later in this detailed description.

The processor now moves to Step S4, at which it communicates the data associated with the voucher 24 to the game controller 8 via the private network 9. In the running example, the data communicated to the game controller includes:

- data indicative of the voucher type that the player has purchased, which in the running example is 'LUCKY5', which specifies that five game plays are associated with the voucher 24;
- data indicative of the numbers selected by the player, which in the running example are 2, 32, 8, 0 and 23;
- data indicative of the amount bet, which in the running example is $20; and
- data indicative of the ticket identification number, which in the running example is ticket no. 049.

The game controller 8 is a server that is connected to the private network. The game controller 8 has a processor and access to a database. At Step S5 the data is received by the game controller 8 and at Step S6 the processor of the game controller 8 establishes a data structure for the voucher 24 and causes the data to be stored in that data structure in the database.

The player is now in possession of a voucher representing the bets they wish to make and is at liberty to proceed to game play at a time of his or her choosing. That is, the time period between the dispensing of the voucher 24 and activation of the voucher 24 is player dependent. However, the casino operator may choose to implement an expiry period, such as three months for example, after which the voucher is invalidated to guard against the casino accumulating excessive liabilities over time. The player may activate the voucher on any table 27 that they choose for any reason, for example the player may decide to play at a table at which their favourite croupier is dealing, or they may decide to play at a table which in the opinion of the player has a favourable run of recent results.

Figure 4:
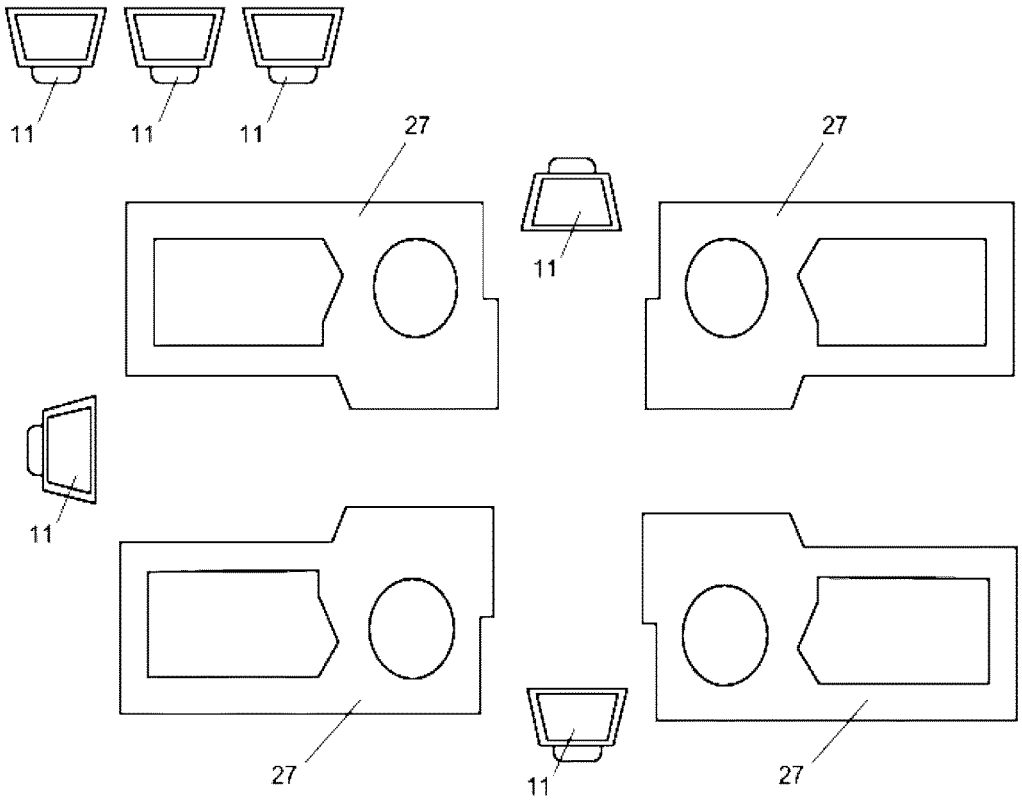
FIG. 4 is a plan view of a plurality of games and voucher dispensers in accordance with a preferred embodiment of the present invention.
Figure 5:
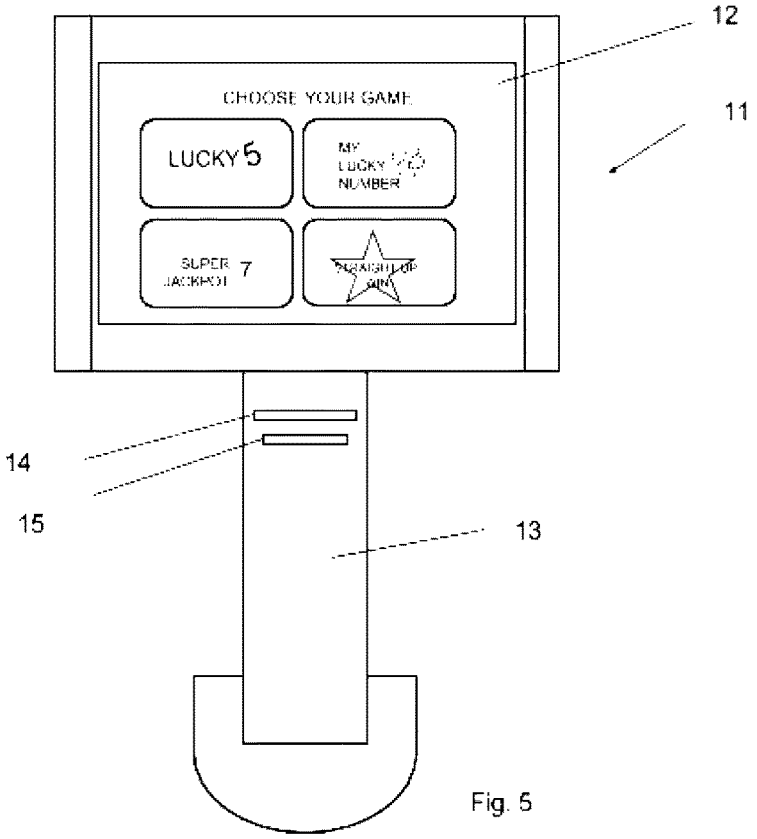
FIG. 5 is a perspective view of a voucher dispenser in accordance with a preferred embodiment of the present invention.
Figure 14:
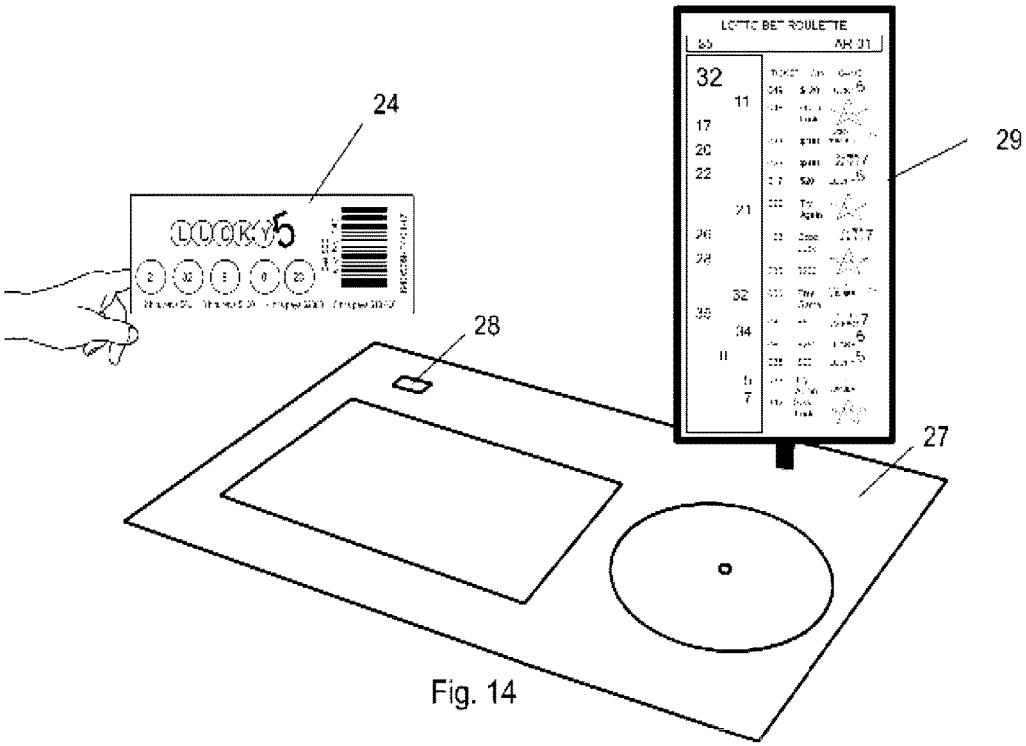
FIG. 14 is a perspective view of a game in accordance with a preferred embodiment of the present invention.
Figure 15:
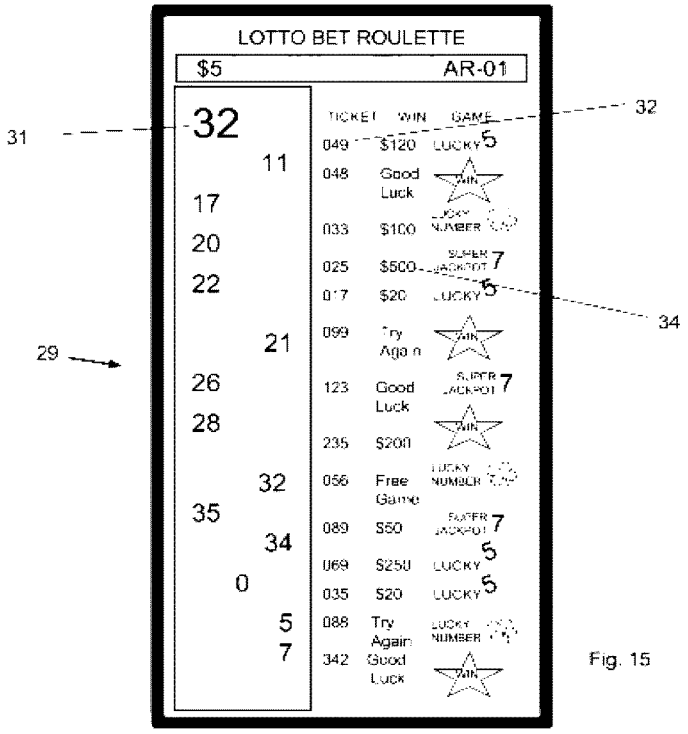
FIG. 15 is a front view of a screen displayed at a game in a preferred embodiment of the present invention.

As shown in FIG. 4, a typical implementation of a gaming area within a casino has a plurality of games, which in FIG. 4 is in the form of four roulette tables 27. A number of voucher dispensers 11 are disposed in the vicinity of the four roulette tables 27. As shown by the white circle of FIG. 14, each of the roulette tables 27 includes an activator device 28 that is communicatively connected to the private network 9. In some embodiments the voucher dispensers 11 are also configured to function as activator devices 28. Each roulette table 27 includes a display 29, as shown for example in FIG. 14, which is mounted so as to be visible to players assembled around the table 27.

As will be understood by those skilled in the art, each of the roulette games is configured to generate game results, which consist of a number defined by a resting position of a ball. In one embodiment each of the roulette tables 27 is configured to automatically sense each game result at the conclusion of each game. In an alternative embodiment, at the conclusion of each game, the dealer manually enters each game result into a key pad. In either case, the game result, along with an identification number uniquely identifying the particular roulette table on which the game result occurred, along with a unique identification number identifying the completed game, are communicated via the private network 9 to the game controller 8 at the conclusion of each game. Upon receipt of this game result data the game controller 8 receives and stores the game result data in its database. At the conclusion of each game, the latest winning number 31 is displayed upon the display 29, with previous winning numbers from previous games being shown below.

The voucher 24 can be used in respect of the games played at any one of the roulette tables 27, with the particular roulette table 27 being selected by the player. Alternatively, the voucher 24 can be used in respect of all of the games played across the four roulette tables. This distinction is defined by the particular activation device 28 at which the player chooses to activate their voucher 24. If activated at an activation device 28 that is disposed on one of the four roulette tables 27, then this indicates that the player wishes to play their games on that specific table 27. However, other activation devices 28 are disposed at locations that are not on any of the roulette tables 27. If the player chooses to activate the voucher at one of these separate activation devices 28, this indicates that the activation is in respect of the results from all four of the roulette tables. For this running example we shall assume that the player chooses to activate their voucher in respect of games at a single roulette table 27. An example of play across multiple tables shall be provided later in this detailed description.

In an alternative embodiment the player makes an input on the touch screen 12 of the voucher dispenser 11 prior to dispensing of the voucher 24, whereby the player selects whether the redeemable value of the voucher 24 is to be based upon game results from a particular roulette table 27, or upon game results from a plurality of roulette tables 27. In yet another embodiment, the player makes the input on the activator device 28 at the time of activating the voucher 24 whereby the player selects whether the redeemable value of the voucher 24 is to be based upon game results from a particular roulette table 27, or upon game results from a plurality of roulette tables 27.

Each activator device 28 has a bar code reader configured to read and decode the bar codes printed onto the vouchers 24. Each activator device 28 also has a unique identification number, which is stored in a memory accessible to the activator device 28.

Figure 18:
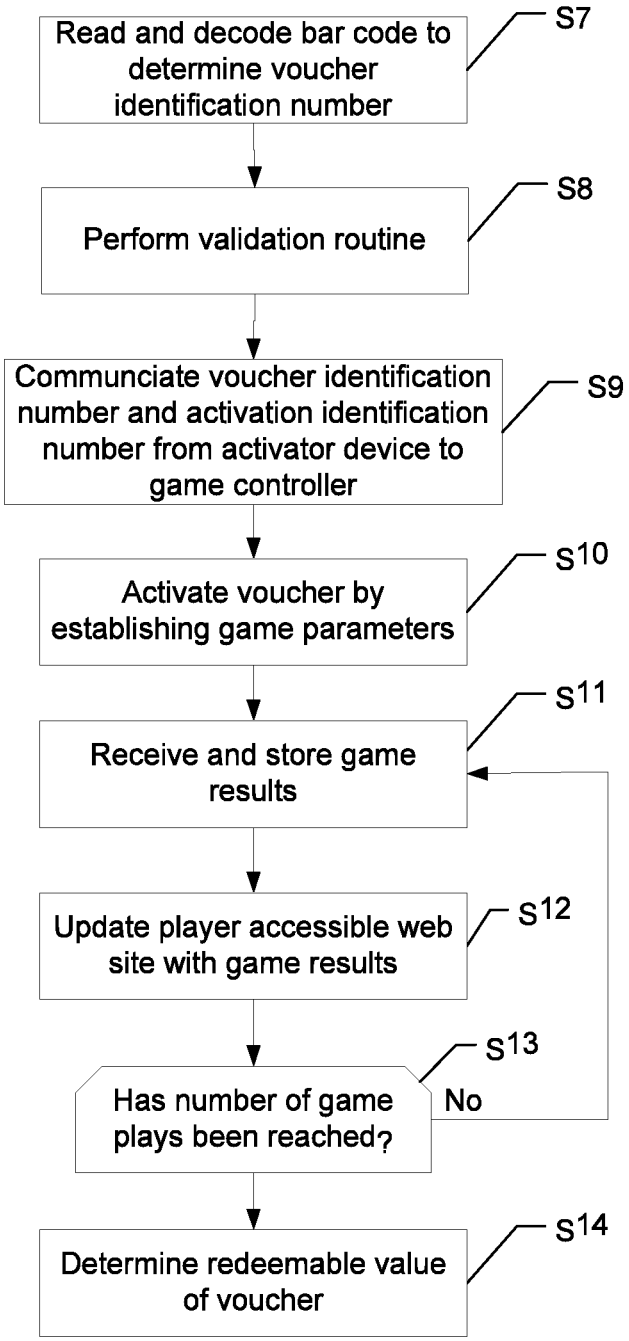

The player selects the particular roulette table 27 upon which he or she wishes to play and gives the voucher 24 to the dealer. The dealer swipes the bar code of the voucher 24 in front of the bar code reader. In an alternative embodiment, the activator devices 28 are positioned on the game tables so as to allow the players to swipe the bar codes on the vouchers 24 past the bar code readers of the activator devices 28 without requiring any assistance from the dealer. At Step S7 of FIG. 18 the bar code reader reads and decodes the bar code to determine the voucher identification number, which in the running example is 049.

At Step S8 the activator device executes a validation routine so as to determine if the voucher 24 was validly dispensed by the system. This is intended to identify any fake vouchers that players may be attempting to fraudulently activate. Various validation techniques are known to those skilled in the art. For example, one such validation technique makes use of a secret validation code that is encoded into the bar code that is printed on the voucher. A mathematical algorithm is used whereby the secret code and the voucher identification number are mathematically combined and the result must fall within a predefined class so to indicate validity. Regardless of the type of validation routine that is employed, if the validation routine determines that the voucher is a fake, the activation device is configured to immediately notify casino security.

If the validation routine determines that the voucher is genuine, then at Step S9 the voucher identification number is communicated via the private network 9 to the game controller 8, along with the activator device identification number. Upon receipt of this communication, the game controller stores the time of receipt in the data structure that was established in the database for the voucher identification number.

At Step S10 the game controller 8 activates the voucher 24 by establishing the game parameters based on the voucher identification number and the activator device identification number. This entails firstly accessing data from the data structure associated with the voucher 24 that was saved earlier when the voucher 24 was dispensed. In particular, the processor of the game controller 8 accesses the data structure to establish the number of game plays associated with the voucher 24. In the running example the number of game plays is 5.

The preceding paragraph is applicable to an embodiment in which the player paid for the voucher when it was dispensed. However, in other embodiments the voucher is paid for when it is activated. In this case, as a prerequisite for activation of the voucher, the player must pay for the voucher, in either currency or casino chips, to the dealer, who causes a signal to be sent to the game controller confirming payment. Only then is Step 10 as described in the preceding paragraph undertaken.

Next the processor of the game controller 8 accesses a look up table to establish whether the activator device identification number is associated with an activator device 28 that is disposed on a particular roulette table 27 (which indicates that the voucher is to be activated with respect to only the game results from that particular roulette table). The other possibility is that the look up table will indicate that the activator device identification number is associated with an activator device 28 that is separate from the roulette tables 27 (which indicates that the voucher is to be activated with respect to all of the game results from the four roulette tables). In the running example the player has activated their voucher 24 using an activation device that is disposed on a specific roulette table. Hence, the processor of the game controller 8 determines from the look up table that the voucher is to be activated only in respect of the results from that particular roulette table 27. In the running example the game controller 8 has now determined that the redeemable value of the voucher 24 is to be based upon next 5 game results from the particular roulette table 27 at which the voucher 24 was activated. The game controller drives the display 29 that is located at the particular roulette table 27 to add the ticket number 30 of the voucher 24 that is now active at that roulette table 27 (i.e. ticket no. 049 in the running example) to the list 32 of other currently active tickets that is shown on the display 29. To keep track of the number of game results received, the processor of the game controller 8 initialises a counter variable to a value of 0.

The time typically required for the system 10 to perform the steps required to activate the voucher (i.e. Steps S7 to S10 inclusive), and to start recording the results of individual games, is extremely short. Hence, from a player's perspective, from virtually the moment the voucher 24 is scanned by the activator device 28, all subsequent games will be applicable to the redeemable value of the voucher until the number of game plays has been completed. Hence, there is little scope for doubt in the player's mind as to which games are applicable to the redeemable value of his or her voucher 24.

In another embodiment a cut-off point is defined for each game. Prior to the cut-off point, the voucher 24 is activatable in respect of the current game that is either about to be commenced, or that has just been commenced but not yet completed, on a particular roulette table. Subsequent to the cut-off point, the voucher 24 is activatable in respect of the game that will follow the current game on the particular roulette table 27. The cut-off point is defined with reference to a stage in the progression of the current game. In one embodiment the cut-off point is defined as 5 seconds after launching of the roulette ball. In another embodiment, the cut-off point is defined as the point at which the speed of the circling roulette ball slows to below a threshold speed. The cut-off point is sensed by the roulette table 27, which causes a "no more bets" sign to be illuminated on the display 29. Additionally, once the cut-off has been sensed, the roulette table 27 communicates this to the game controller 8. This enables the game controller 8 to determine whether a voucher activation is to be applicable to a current game (i.e. if the activation occurs prior to the cut-off point) or to the following game (i.e. if the activation occurs subsequent to the cut-off point). In this embodiment, once a voucher is activated on a particular roulette table 27, a message is displayed on display 29, which identifies for each voucher 24 the game identification number for which that voucher 24 has been activated. For example, assume that roulette game identification no. 316 is about to commence and prior to the cut-off point, activated vouchers 24 are identified on the display 29 as activated in relation to game no. 316. However, those vouchers 24 that are activated subsequent to the cut-off point are identified on the display 29 as activated in relation to game no. 317.

As a game is completed on the particular roulette table 27, the game result is automatically sensed by the roulette table 27 and the display 29 is updated to show the latest winning number 31. The roulette table 27 also communicates the game result and its roulette identification number to the game controller 8. The process flow now moves onto Step S11 at which a game result from the particular roulette table 27 is received by the game controller 8 and stored in the game controller's database in the voucher's data structure. The processor of the game controller 8 increments the counter variable by 1.

Once the game controller 8 has established which, if any, of the vouchers 24 have won a particular roulette game, the display 29 is updated to include winning messages 34 that are presented adjacent the winning vouchers as shown in the list 32. This identification of the vouchers that have just won a particular roulette game typically helps to contribute to player excitement.

Figure 12:
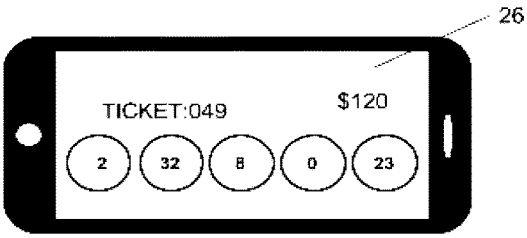
FIG. 12 is a plan view of a screen displayed on a player's hand held digital device in accordance with a preferred embodiment of the present invention.
Figure 13:
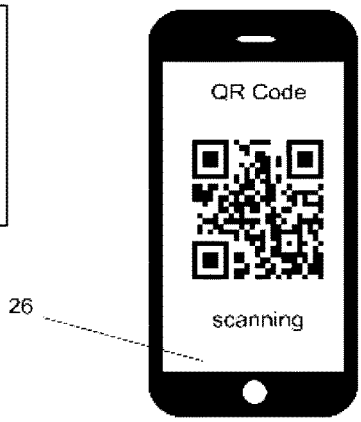
FIG. 13 is a plan view of another screen displayed on a player's hand held digital device in accordance with a preferred embodiment of the present invention.

The process flow now proceeds to Step S12 at which the web site hosted by the game controller 8 is updated to include the latest game results that are applicable to voucher 24. This is the web site that was pointed to by the QR code 25 that was displayed to the player when the voucher 24 was dispensed. The player uses their hand held digital device 26 to access the web site, which causes a display such as that shown in FIG. 12 to be displayed on the player's device 26. Shortly after the web site is updated at Step S12 with new game results, they are viewable on the player's device so that the player may keep informed essentially in real time of the game results that will impact upon the redeemable value of their voucher 24.

Whilst the game results are being determined, the player has the option of viewing the game results on his or her hand held digital device 26. This is particularly advantageous if the player is not in the immediate vicinity of the roulette table 27. For example, this functionality allows the player to review the game results as each game is completed from a remote location, such as a bar, or the like.

Whilst the game results are being determined (i.e. whist the process flow is looping between Steps S11 and S13), the players may choose to suspend the activation, for example allowing the player to depart from the roulette table 27 temporarily to get some food or drink In this case either the player, or the dealer, positions the voucher in front of the bar code reader, which sends a message identifying the voucher to the game controller 8. The game controller then toggles the status of the voucher from 'activated' to 'activation temporarily suspended'. Whilst temporarily suspended, any game results arising from the particular roulette table 27 are not applicable to a determination of the redeemable value of the voucher 24 and the counter variable is not incremented. However, the voucher is subsequently re-activatable. More particularly, once the player returns and wishes to reactive the voucher, the voucher is again presented to the bar code reader of the activator unit 28, which sends another message identifying the voucher 24 to the game controller 8. The game controller then toggles the status of the voucher from 'activation temporarily suspended' to 'activated' and once again the results of games completed on the particular roulette table are applicable to the redeemable value and the counter variable is incremented upon each completion of a game on the particular roulette table 27. There is no limit to the number of times a voucher could be suspended and re-activated, subject to the number of game plays associated with the voucher.

The process flow proceeds to loop limiting Step S13, at which the processor determines whether the counter variable is equal to the number of game plays (i.e. 5 in the running example). If not, the process flow loops back to Step S11. If the counter variable is equal to the number of game plays, the game controller deactivates the voucher 24 and process flow proceeds to Step S14.

At Step S14 the processor of the game controller 8 has the information necessary to determine the redeemable value of the voucher 24. In accordance with the rules of the 'LUCKY 5' voucher type, the game controller 8 conducts a comparison of the five player selected numbers as saved in the voucher's data structure against the five game results as saved in the voucher's data structure. In one possible implementation of the 'LUCKY 5' voucher type, any of the player selected numbers may be matched against any of the game results, which is referred to as unordered matching. In another implementation, the first player selected number is only matchable against the first game result; the second player selected number is only matchable against the second game result, and so on, which is referred to as ordered matching. In some implementations, a single player selected number may be matched with multiple game results, which is referred to as unordered repeat matching. In other implementations, a single player selected number may only be matched with a single game result, which is referred to as unordered non-repeat matching. It will be appreciated that the particular rules used to determine matches will impact upon the winning probabilities and hence the payout structure must be tailored appropriately. For the running example we shall assume that the five game results are:

35,23, 10, 23 and 0.

For the sake of the running example we shall assume that the matching is of the unordered repeat type. Hence, the processor of the game controller 8 determines that three matches have occurred (i.e. the fourth player selected number, 0, is matched by the fifth game result, 0; and the fifth player selected number, 23 is matched by the second and fourth game results, 23.) Next the processor of the game controller 8 assesses the voucher's data structure to determine the amount bet on the voucher 24, which in the running example is $20. This defines the look up table to which the processor of the game controller 8 refers to determine the redeemable amount for the voucher 24. In accordance with the payout table for a $20 bet in the 'LUCKY 5' game, the payout for three matches is $120. Hence, the processor determines at step S14 that the redeemable value of the voucher is $120 and this amount is stored in the voucher's data structure.

The above redeemable value was calculated based on the total number of matches across all of the games. However, other voucher types allow the player to simply place a series of standard bets on a specified number of game plays. For such voucher types, the redeemable value is calculated in accordance with the standard roulette pay table as calculated for each separate game.

Another embodiment features the option of using the player's hand held digital device 26 as the activator device (instead of, or in addition to, making use of a casino-supplied activation device 28). In one version of such an embodiment, the player's hand held digital device 26 navigates to, and executes steps defined by, a casino-hosted web site. In another version of such an embodiment, an executable 'app' is downloaded onto the player's hand held digital device. In either case the player uses the native input device of the player's hand held digital device 26 to make inputs that define the information required for activation. Depending upon system implementation and the player's wishes, this may include specifying the particular roulette table or roulette tables in respect of which the player wishes to activate their voucher 24. Once the player makes an input that commits to activation, an activation signal is sent either from the player's hand held digital device 26, or from the casino-hosted web site, to the game controller 8. Once this communication is received, the game controller 8 administers the activation in the manner outlined above.

Figure 16:
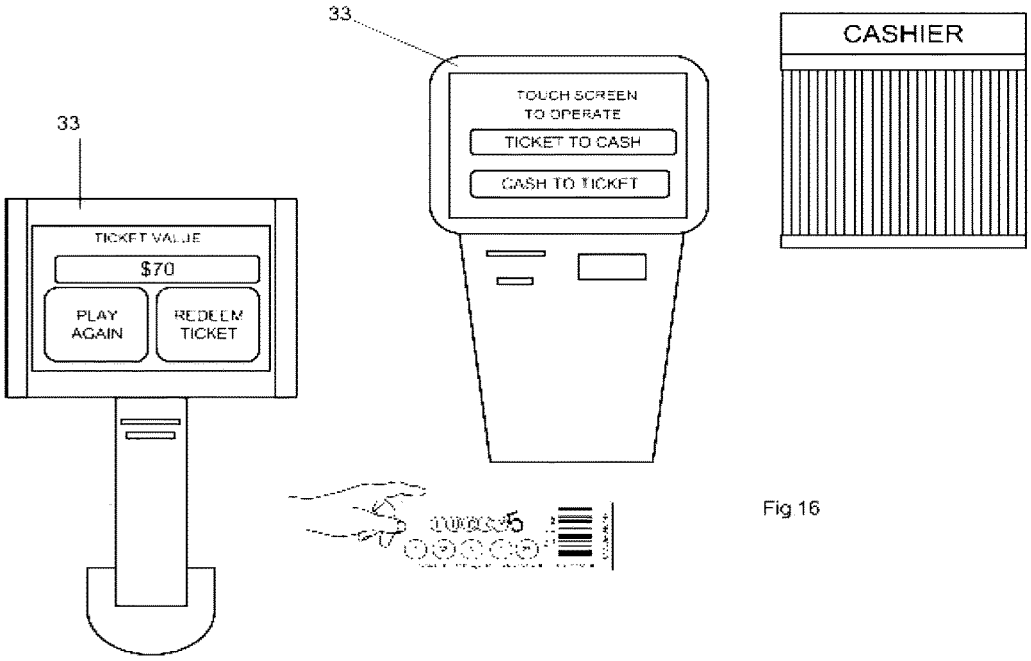
FIG. 16 shows perspective views of some options for redeeming the redeemable value of a voucher in a preferred embodiment of the present invention.
Figure 19:
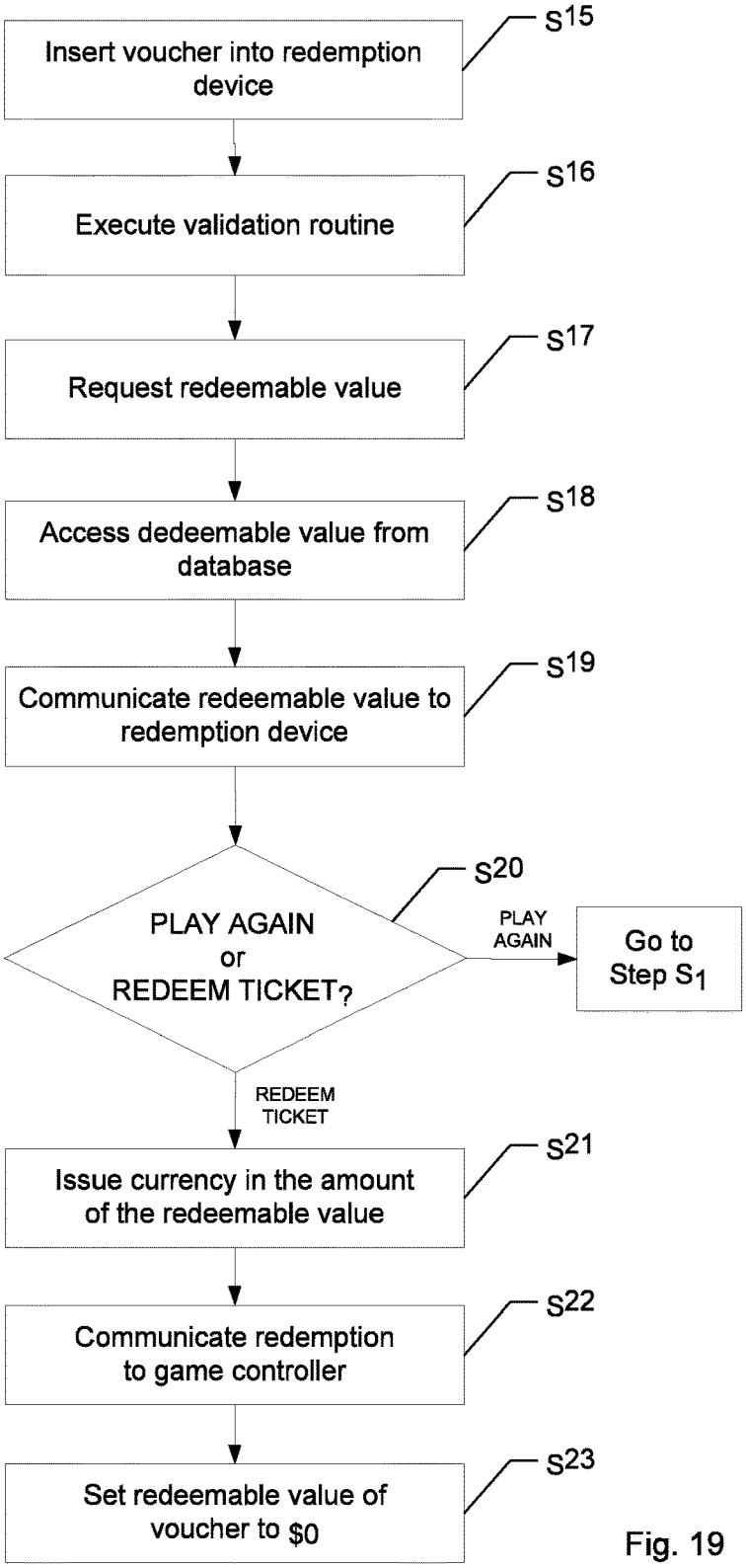

The player is now free to redeem the redeemable value of the voucher 24 at a time of his or her choosing (subject to any expiry limitations that may be set by the casino operator). To redeem the redeemable value, the player may utilise a redemption device 33 as illustrated in FIG. 16. Alternatively, the player may choose to redeem the redeemable value of the voucher 24 at the casino cashier. In some embodiments the voucher dispensers 11 also function as redemption devices 33. At Step S15 of FIG. 19 the player inserts the voucher 24 into the second slot 15 and a bar code reader disposed within the body 13 of the redemption device 33 reads and decodes the bar code, which reveals the voucher identification number, which in the running example is 049.

At Step S16 the redemption device 33 executes a validation routine so as to check the validity of the voucher 24. If the validation routine determines that the voucher 24 is a fake, the redemption device 33 is configured to immediately notify casino security. If the validation routine determines that the voucher 24 is genuine, then at Step S17 the voucher identification number is communicated via the private network 9 to the game controller 8, along with a request to return the redeemable value. At Step S18 the game controller 8 accesses the data structure to ascertain the redeemable value and at Step S19 the game controller 8 communicates this value to the redemption device 33.

At Step S20 the redemption device 33 displays the redemption value to the player on the screen 12, along with touch sensitive screen regions providing input means for the player to either select 'PLAY AGAIN' or 'REDEEM TICKET'. If the player selects 'PLAY AGAIN', then some or all of the redeemable value may be used as the bet amount for establishing another game, in which case the process flow reverts to Step S1. However, if the player selects "REDEEM TICKET", then at Step S21 the processor of the redemption device 33 instructs the bill collector to issue currency equal to the redemption value through the first slot 14, which in the running example is $120. Once the currency has been issued, at Step S22 the processor of the redemption device 33 issues a signal to inform the game controller 8 that redemption is complete. Upon receipt of this signal, at Step S23 the game controller 8 sets the redeemable value of the voucher 24 to $0.

The description above related to the processing of a single voucher. However, it will be appreciated that in a typical casino implementation it is likely that a plurality of vouchers will be concurrently active. Various vouchers will have various voucher types, with associated payout structures, bet amounts, numbers of game plays, etc. It is the job of the game controller 8 to manage these multiple vouchers, to record the game results that are applicable to each, and, ultimately, to calculate a redeemable value for each of them once the relevant number of game plays has been concluded. For example, at a particular time on a particular table, one player might have a voucher which is simply repeating a standard bet for a series of eight games. Another player may have chosen ten numbers over a series of fifteen games and hopes to maximise the number of matches. The server will keep track of these vouchers in real time and deactivate each voucher when its run of game plays has completed.

In the above description the vouchers 24 took the form of a printed substrate. However, in other embodiments the vouchers are in the form of digital devices such as RFID tags upon which the voucher identification number and some or all of the other data associated with the voucher is stored. The voucher identification number is accessed by RFID read/write units disposed on the the activation devices 28 and the redemption devices 33.

In another embodiment the vouchers are in the form of information, and in particular a voucher identification number, communicated from the voucher dispenser 11 to player's hand held digital device, such as a mobile phone, a tablet, a personal digital assistant, etc. The voucher identification number is communicated to the player's hand held device via any one of a number of possible communications formats, such as via a near field communication transceiver, an infrared transceiver, a bluetooth transceiver, short message service, WiFi or the like. For activation and redemption the voucher identification number is accessed from the player's hand held digital device by compatible read/write units disposed on the activation devices 28 and the redemption devices 33.

In yet another embodiment the player's hand held digital device 26 functions as a voucher dispenser 11. In this embodiment the casino makes an application (referred to as an 'app') available to be downloaded onto the player's hand held digital device 26. Running this app allows the player to input the information that is described above as being required at Step S1, however the information is inputted via the input means of the player's hand held digital device 26, such as via a touch screen, buttons, etc. The app also allows for payment for the voucher via a funds transfer that is conducted by the player's hand held digital device 26. Once the voucher is dispensed, the mobile phone communicates via a near field communication transceiver, an infrared transceiver, a bluetooth transceiver, short message service, WiFi or the like, to ensure that the game controller is informed of the data associated with the voucher 24.

As an alternative to the 'app' embodiment discussed in the preceding paragraph, another embodiment simply requires the player to use their hand held digital device 26 to navigate to a web site hosted by the casino. The web site presents the player with the input screens required to define the voucher data and this facilitates communication via the intern& of the voucher data to the game controller and communication of the voucher identification number to the player's hand held digital device 26.

In some above-described embodiments that make use of the player's hand held digital device, indicia indicative of at least some of the data, and in particular the voucher identification number, is displayed on a display of the player's hand held digital device. This may be in the form of a machine readable code, such as a bar code or QR code, PIN number. Alternatively, a software instruction within the digital device may cause the digital device to display the information. For the purposes of activation and redemption, this display is optically readable by sensors on the activation devices 28 and on the redemption devices 33.

Figure 20:
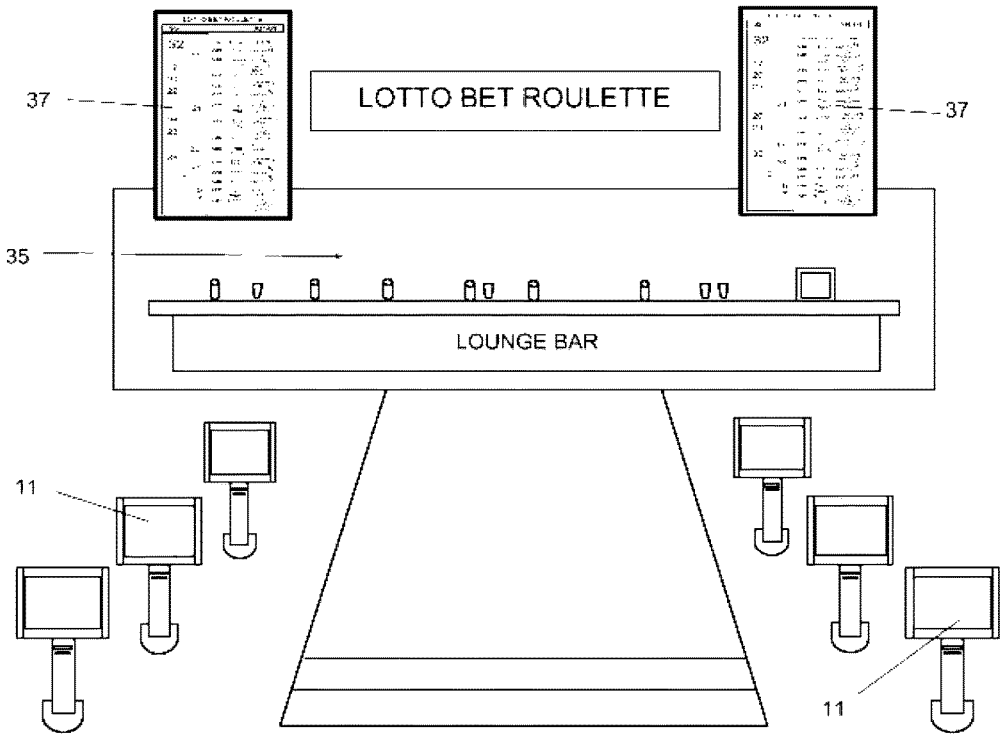
FIG. 20 is a perspective view of a communal area in which a player may participate in a preferred embodiment of the present invention.
Figure 21:
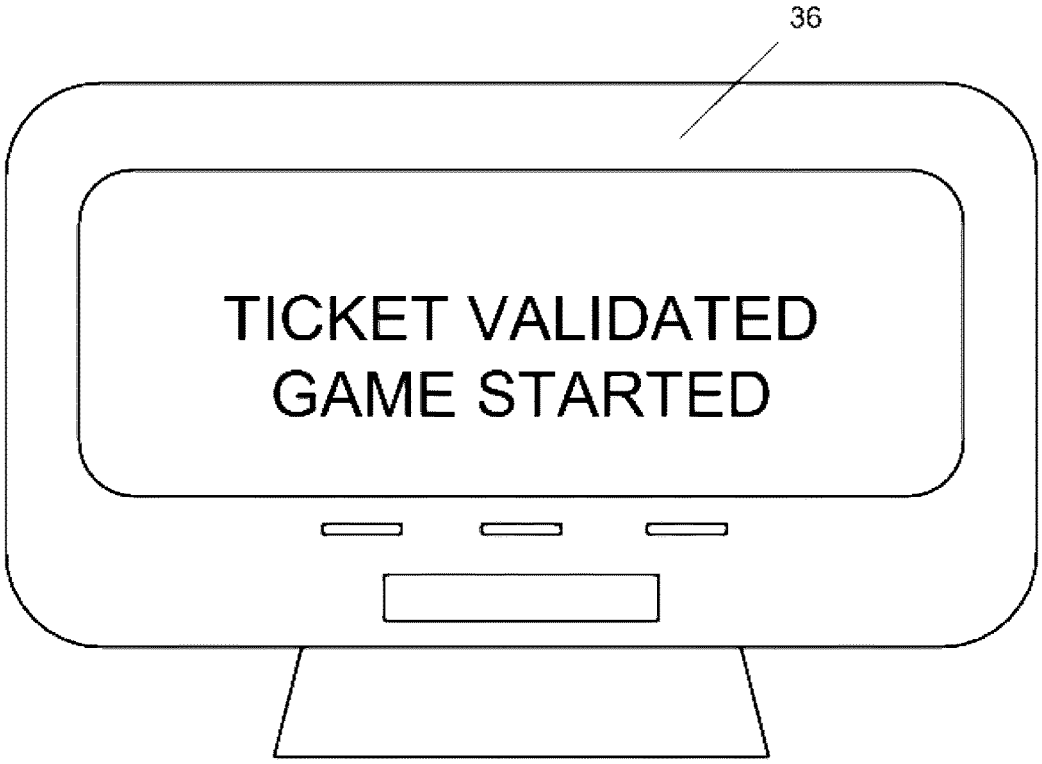
FIG. 21 is front view of an activator device in accordance with a preferred embodiment of the present invention.

As mentioned earlier, in another embodiment game results from a plurality of roulette tables 27 are used to determine the redeemable value of a voucher. The bulk of the hardware for this embodiment is as per the above description; however the software for this embodiment configures the hardware to function in the manner described below. This embodiment is anticipated to be particularly suited for use in a communal area 35, such as the bar shown in FIG. 20, around which a number of voucher dispensers 11 and activator devices 28 are provided. Typically the communal area 35 would be in the general vicinity of the roulette tables 27, however this is by no means essential.

In this embodiment the player provides inputs to a voucher dispenser 11 to define data associated with the voucher, which includes a voucher identification number and the player's desired betting structure. Many players choose to make use of a standard betting structure for all of their games in which the size and location of their bets does not vary from game to game. The inputting of the data provides an opportunity for this standard betting structure to be defined. For the sake of a new running example we shall assume that the player decides to purchase a voucher type in which the player selects 10 game results, which are to be applicable to 10 game plays. This game type advantageously provides a payout structure that allows for both frequent small payouts (when a couple of the player's numbers are matched in the 10 games) and infrequent very large payouts (when all 10 of the players numbers are matched in the 10 games). On average, the expectation for such a game is that 28% of games played will yield a win of some amount. In some embodiments a substantial bonus amount, such as $1 million dollars in return for a $5 bet, for example, is awardable if all 10 of the possible game results upon which the player bet are matched by all 10 of the game results.

The player inputs the 10 possible game results upon which bets are to be placed. These are 10 of the numbers that may be generated by the operation of the roulette tables 27. Alternatively, the player may select an 'autopick' option whereby the processor of the voucher dispenser 11 is configured to randomly, or pseudo-randomly, select the player's 10 numbers. The player also selects the amount that he or she wishes to bet on this voucher. Once payment for the voucher has been received, the voucher dispenser prints the voucher with a bar code encoding the voucher identification number, which is dispensed to the player. The data associated with the voucher is communicated from the voucher dispenser 11 to the game controller 8, where it is stored in the database in a data structure associated with the voucher.

When the player wishes to activate the voucher, the player swipes the bar code in front of the bar code reader that is disposed on one of the activator devices 36 that is located at the communal area 35. After executing the validation routine and confirming that the voucher is valid, the activator device 36 sends a message to the game controller 8 that includes both the activator device's identification number and the voucher identification number. The game controller then activates the voucher by establishing the game parameters. The gaming controller 8 accesses the data structure in its database that is associated with the voucher to ascertain the player's betting structure (which in this running example is 10 game results being bet upon over 10 games). Additionally, the game controller 8 looks up a look up table to ascertain that the activator device's identification number is associated with an activator device 28 that is disposed in the communal area 35, which indicates that the results of games conducted on all four of the roulette tables as shown in FIG. 4 will be applicable to the determination of the redeemable value of this voucher. However, as a security feature, any game that had already gone past its cut off point at the time of voucher activation is not applicable to the determination of the redeemable value of this voucher. The games as played across the four tables are each identified by consecutively increasing game numbers that are assigned by the gaming controller. The game number of the first applicable game for the purposes of determining the redeemable value of the voucher is calculated by adding the number of games that are past their cut off point at the time of voucher activation to the current game number. For example, assume that at voucher activation the current game number was 316 and at that point in time two games were past their cut off points. In this situation the first applicable game would be game number 318 (i.e. 316+2).

From game number 318 onwards the game controller 8 begins to record the game results coming from any of the four roulette tables 27 in the data structure that is associated with the voucher. An advantage with making the results of games conducted across a plurality of games applicable is that the overall outcome of the player's voucher is determined quicker than would be typically possible if the results from only a single roulette table were applicable. When taking the results from four roulette tables together, a typical average game completion rate of between approximately 100 and 200 games per hour may be anticipated. Hence, at this average game completion rate, it is likely to take approximately 3 to 6 minutes for the 10 games to be completed. Whereas, at the same average game completion rate, if the results from only a single table are being used, it is likely to take approximately 12 to 24 minutes to complete the 10 games.

As each game is completed displays 37 located in the communal area 35 show the currently active vouchers and the results of each completed game. Players can peruse this information in the relative comfort and informality of a bar setting. Additionally, by making use of embodiments outlined in more detail previously, the players can follow the game results on their hand held digital devices, if they so choose.

Once the game controller has recorded game results from 10 games, the voucher is deactivated and a redeemable value can be calculated based upon:

- the number of matches between the player's numbers and the game results; and
- the amount bet by the player, which defines the payout structure that is associated with the voucher type played.

Once the redeemable value has been calculated, this value may be redeemed by the player in the same manner outlined previously.

Another embodiment dispenses with the requirement for the player to activate the voucher. This embodiment uses essentially the same hardware as the above-described embodiments with the exception of the activator devices 28, which are not required. Additionally, in this embodiment the software configures the voucher dispensers 11, the gaming controller 8 and the gaming devices 27 to function in the manner described below.

The gaming controller 8 receives electronic signals from each of the gaming devices 27 (which, in the preferred embodiment are roulette tables) that encode the current status of each of the roulette tables 27. This includes an indication as to whether any particular roulette table 27 has passed its cut off point. This information is collated by the gaming controller 8 and stored in its memory. The gaming controller 8 also allocates and stores game numbers for each of the games each time one of the roulette tables 27 reports a game result to the gaming controller 8. That is, whenever one of the roulette tables 27 sends a message informing the gaming controller 8 of the results of a game that has just been executed, the gaming controller 8 allocates the next available game number to that game. For the sake of an example we shall assume that the last game for which a gaming result has been reported to the gaming controller was game number 209. This means that the gaming controller 8 is aware that the current game is game number 210. For the example we shall assume at this point that a player wishes to obtain a voucher relating to games played across four roulette tables and we shall assume at this point that two of the four roulette tables 27 have passed their cut off point. The player provides an input to the voucher dispenser 11 by pressing buttons which indicate that a voucher is required to be dispensed and which define the type of gaming in which the player wishes to engage. In response to this input the player is given an opportunity to pay for the voucher in the manner described previously and the voucher dispenser 11 sends a request to the gaming controller 8 for a commencing game number (which is the game number of the first game that will be relevant to determining the redeemable value of the voucher that is to be dispensed).

When the gaming controller 8 receives the request from the voucher dispenser 11, the processor of the gaming controller 8 analyses the current status of the four gaming devices 27 so as to determine the commencing game number. In one embodiment the processor determines the number of gaming devices that have passed the cut-off point and increments the current game number by the number of gaming devices that have passed the cut-off point so as to calculate the commencing game number. In the example the current game number is 210 and the number of games that have past their cut off points is 2. Hence, the processor increments 210 by 2 to yield a commencing game number of 212.

In another embodiment the processor of the gaming controller 8 is configured to make the calculations mentioned in the preceding paragraph and then to further increment that amount by a predefined number of games. The predefined number of games is selected so as to give the player to whom the voucher is to be issued sufficient time to collect the voucher and make his or her way to the applicable gaming device 27. Typically, the predefined number of games would be 1 or 2. Hence, in the above example, if the predefined number of games is 1, then the processor of the gaming controller 8 would determine that the commencing game number is 213 (i.e. 212+1). If the predefined number of games is 2, then the processor of the gaming controller 8 would determine that the commencing game number is 214 (i.e. 212+2).

Once the gaming controller 8 has determined the commencing game number, this number is communicated to the voucher dispenser 11. Upon receiving the commencing game number, and once the player has paid for the voucher, the voucher dispenser 11 dispenses the voucher 24 to the player. In one embodiment the voucher dispenser 11 provides an indication to the player of the commencing game number by printing that number on voucher 24. Additionally, or alternatively, the voucher dispenser 11 provides an indication of the commencing game number to the player on the display screen 12. Hence, the player is now in possession of a voucher 24 that will automatically commence being active when a game having the commencing game number is starts. Advantageously, this avoids the ambiguity regarding the commencing game that may apply in the Klinkhammer prior art system, which merely provides the player with a time at which the voucher commences being active.

While a number of preferred embodiments have been described, it will be appreciated by persons skilled in the art that numerous variations and/or modifications may be made to the invention without departing from the spirit or scope of the invention as broadly described. The present embodiments are, therefore, to be considered in all respects as illustrative and not restrictive.

The claims defining the invention are as follows:

1. A gaming system including:

at least one voucher dispenser configured to be responsive to an input so as to dispense vouchers to players, each voucher being associated with data identifying the voucher and specifying a number of game plays;

a gaming controller communicatively linked to the voucher dispenser and being configured to receive and store said data associated with each voucher;

at least one game being configured to generate game results, the game being communicatively linked to the gaming controller so as to communicate game results to the gaming controller; and at least one activator device at which the vouchers are activatable, the activator device being communicatively linked to the gaming controller such that an activation of a voucher causes the gaming controller to determine a redeemable value of said voucher based upon the game results of the number of game plays subsequent to activation as specified in the data associated with said voucher.

2. A gaming system according to claim 1 wherein the vouchers are a substrate having indicia printed thereon.

3. A gaming system according to claim 1 wherein the vouchers are digital devices.

4. A gaming system according to claim 1 wherein the vouchers are in the form of information communicated to player's hand held digital devices.

5. A gaming system according to claim 1 wherein the at least one voucher dispenser is a player's hand held digital device.

6. A gaming system according to claim 4 wherein indicia indicative of at least some of the data is displayed on a display of the player's hand held digital device.

7. A gaming system according to claim 1 wherein the data includes a player defined betting structure.

8. A gaming system according to claim 7 wherein the gaming controller is responsive to an identification of a voucher so as to retrieve the betting structure associated with said voucher and so as to determine the redeemable value in accordance with the betting structure associated with said voucher.

9. A gaming system according to claim 1 wherein the voucher dispenser is configured to dispense a voucher in response to settlement of a payment transaction in which the player pays for the voucher.

10. A gaming system according to claim 1 wherein the activator device is configured to activate a voucher in response to settlement of a payment transaction in which the player pays for the voucher.

11. A gaming system according to claim 1 wherein the vouchers are activatable in respect of the game results generated at any one of a plurality of games.

12. A gaming system according claim 1 wherein the vouchers are activatable in respect of the game results generated across a plurality of games.

13. A gaming system according to claim 1 wherein the activator device is configured to execute a validation routine so as to determine if a voucher was validly dispensed by the system and to only activate said voucher if the validation routine indicates that said voucher is valid.

14. A gaming system according to claim 1 wherein the gaming controller is configured to deactivate a voucher once the specified number of game plays have been played.

15. A gaming system according to claim 1 wherein the game includes a display driven to identify vouchers that are currently active on said game.

16. A gaming system according to claim 15 wherein the display is driven to identify vouchers that are currently winning on said game.

17. A gaming system according to claim 1 wherein the activator device is configured to be responsive to an input so as to suspend activation of a voucher prior to the specified number of game play being completed, the suspended voucher being subsequently re-activatable.

18. A gaming system according to claim 1 including at least one redemption device configured so as to redeem the redeemable value of a voucher to a player.

19. A gaming system according to claim 4 wherein the game results are viewable on a display of a player's hand held digital device.

20. A gaming system according to claim 1 wherein a time period between a dispensing of a voucher and activation of said voucher is player dependent.

21. A gaming system according to claim 1 wherein a cut-off point is defined, whereby prior to the cut-off point the voucher is activatable in respect of a current game and subsequent to the cut-off point the voucher is activatable in respect of a following game.

22. A gaming system according to claim 21 wherein the cut-off point is defined as a stage of progression of the current game.

23. A gaming system according to claim 21 wherein a voucher is activatable in respect of the game results generated across a plurality of games and wherein any game that had already gone past its cut off point at the time of voucher activation is not applicable to the determination of the redeemable value of the voucher.

24. A gaming system according to claim 23 wherein each of the plurality of games is identified by a game number and a game number of a first applicable game for the purposes of determining the redeemable value of the voucher is calculated by adding a number of games that are past their cut off point at a time of voucher activation to a current game number.

25. A gaming system according to claim 1 wherein the activator device is a player's hand held digital device.

26. A gaming method including the steps of:

dispensing vouchers to players, each voucher being associated with data identifying the voucher and specifying a number of game plays, and communicating the data to a gaming controller;

providing a game being configured to generate game results and to communicate said game results to the gaming controller; and being responsive to an activation of a voucher so as to cause the gaming controller to determine a redeemable value of said voucher based upon the game results of the number of game plays subsequent to activation as specified in the data associated with said voucher.

27. A gaming method according to claim 26 wherein the data includes a plurality of possible game results upon which bets are to be placed.

28. A gaming method according to claim 27 wherein the redeemable value includes a bonus award if the game results of the number of game plays as specified in the data associated with the voucher matches the plurality of possible game results.

29. A gaming method according to claim 28 wherein the selected game is roulette and wherein the plurality of possible game results upon which bets are to be placed are a plurality of numbers that may be generated by the operation of one or more roulette tables.

30. A gaming system including:

at least one voucher dispenser configured to be responsive to an input so as to dispense a voucher to a player;

a gaming controller communicatively linked to the voucher dispenser; and at least one gaming device being configured to generate game results, the at least one gaming device being communicatively linked to the gaming controller so as to communicate a current status of the at least one gaming device to the gaming controller;

wherein the gaming controller is configured to collate game numbers associated with each game executed upon the at least one gaming device;

wherein the voucher dispenser is responsive to the input so as to send a request to the gaming controller for a commencing game number for a voucher that is to be dispensed;

wherein the gaming controller is responsive to receipt of the request so as to analyse the current status of the at least one gaming device so as to determine a number of gaming devices that have passed a cut-off point and to increment a current game number by the number of gaming devices that have passed the cut-off point and to increment this amount by a predefined number of games so as to calculate the commencing game number and so as to communicate the commencing game number to the voucher dispenser; and wherein the voucher dispenser is responsive to receipt of the commencing game number so as to dispense a voucher and provide an indication to the player of the commencing game number for the voucher.

31. A gaming system according to claim 30 wherein the indication to the player is printed on the voucher.

32. A gaming system according to claim 30 wherein the voucher dispenser includes a display and the indication to the player is displayed on the display.

33. A gaming system according to claim 30 wherein the gaming device is a roulette table.

* * * * *